US007739120B2

(12) United States Patent
Mäkinen

(10) Patent No.: US 7,739,120 B2
(45) Date of Patent: Jun. 15, 2010

(54) SELECTION OF CODING MODELS FOR ENCODING AN AUDIO SIGNAL

(75) Inventor: Jari Mäkinen, Tampere (FI)

(73) Assignee: Nokia Corporation, Espoo (FI)

( * ) Notice: Subject to any disclaimer, the term of this patent is extended or adjusted under 35 U.S.C. 154(b) by 1204 days.

(21) Appl. No.: 10/847,651

(22) Filed: May 17, 2004

(65) Prior Publication Data

US 2005/0256701 A1 Nov. 17, 2005

(51) Int. Cl.
*G10L 19/00* (2006.01)
*G10L 21/00* (2006.01)

(52) U.S. Cl. ..... 704/501; 704/201; 704/219

(58) Field of Classification Search ..... 704/219, 704/223, 208, 214
See application file for complete search history.

(56) References Cited

U.S. PATENT DOCUMENTS

| | | | | |
|---|---|---|---|---|
| 6,134,518 | A * | 10/2000 | Cohen et al. | 704/201 |
| 6,633,841 | B1 | 10/2003 | Thyssen et al. | |
| 6,785,645 | B2 * | 8/2004 | Khalil et al. | 704/216 |
| 2002/0054646 | A1 | 5/2002 | Tsushima et al. | |
| 2005/0075873 | A1 | 4/2005 | Makinen | |

FOREIGN PATENT DOCUMENTS

| | | |
|---|---|---|
| EP | 0 932 141 | 7/1999 |
| EP | 1 278 184 | 1/2003 |
| WO | 0165544 A1 | 9/2001 |

OTHER PUBLICATIONS

Ramprashad, "A Multimode Transform Predictive Coder (MTPC) for Speech and Audio", Proc. IEEE Workshop on Speech Coding for Telecom, pp. 10-12, Jun. 1999.*

"A Wideband Speech and Audio Codec at 16/24/32 Kbits Using Hybrid ACELP/TCS Techniques" by B. Bessette et al, Speech Coding Proceedings, 1999 IEEE Workshop on Porvoo, Finland, Jun. 20-23, 1999, Piscataway, NJ, IEEE, Jun. 20, 1999, pp. 7-9.

"Source signal based rate adaptation for GSM AMR speech codec" by J. Makinen et al, Information Technology: Coding and Computing, 2004. Proceedings, ITCC 2004. International Conference on Las Vegas, Nevada, Apr. 5-7, 2004, Piscataway, NJ, IEEE, vol. 2, Apr. 5, 2004, pp. 308-313.

3GPP TS 26.190 (V5.1.0 (2001-12), 3rd Generation Partnership Project; Technical Specification Group Services and System. Aspects; Speech Codec speech processing functions; AMR Wideband speech codec; Transcoding functions (Release 5).

Peru Office Action (Application No. 000527-2005/OIN) dated Mar. 10, 2008, Technical Report CAMV 74-2007/A (17 pages), CAMV 74/A Search Report (2 pages).

* cited by examiner

*Primary Examiner*—David R Hudspeth
*Assistant Examiner*—Samuel G Neway

(57) ABSTRACT

The invention relates to a method of selecting a respective coding model for encoding consecutive sections of an audio signal, wherein at least one coding model optimized for a first type of audio content and at least one coding model optimized for a second type of audio content are available for selection. In general, the coding model is selected for each section based on signal characteristics indicating the type of audio content in the respective section. For some remaining sections, such a selection is not viable, though. For these sections, the selection carried out for respectively neighboring sections is evaluated statistically. The coding model for the remaining sections is then selected based on these statistical evaluations.

19 Claims, 3 Drawing Sheets

SELECTION OF CODING MODELS FOR ENCODING AN AUDIO SIGNAL

FIELD OF THE INVENTION

The invention relates to a method of selecting a respective coding model for encoding consecutive sections of an audio signal, wherein at least one coding model optimized for a first type of audio content and at least one coding model optimized for a second type of audio content are available for selection. The invention relates equally to a corresponding module, to an electronic device comprising an encoder and to an audio coding system comprising an encoder and a decoder. Finally, the invention relates as well to a corresponding software program product.

BACKGROUND OF THE INVENTION

It is known to encode audio signals for enabling an efficient transmission and/or storage of audio signals.

An audio signal can be a speech signal or another type of audio signal, like music, and for different types of audio signals different coding models might be appropriate.

A widely used technique for coding speech signals is the Algebraic Code Excited Linear Prediction (ACELP) coding. ACELP models the human speech production system, and it is very well suited for coding the periodicity of a speech signal. As a result, a high speech quality can be achieved with very low bit rates. Adaptive Multi-Rate Wideband (AMR-WB), for example, is a speech codec which is based on the ACELP technology. AMR-WB has been described for instance in the technical specification 3GPP TS 26.190: "Speech Codec speech processing functions; AMR Wideband speech codec; Transcoding functions", V5.1.0 (2001-12). Speech codecs which are based on the human speech production system, however, perform usually rather badly for other types of audio signals, like music.

A widely used technique for coding other audio signals than speech is transform coding (TCX). The superiority of transform coding for an audio signal is based on perceptual masking and frequency domain coding. The quality of the resulting audio signal can be further improved by selecting a suitable coding frame length for the transform coding. But while transform coding techniques result in a high quality for audio signals other than speech, their performance is not good for periodic speech signals. Therefore, the quality of transform coded speech is usually rather low, especially with long TCX frame lengths.

The extended AMR-WB (AMR-WB+) codec encodes a stereo audio signal as a high bitrate mono signal and provides some side information for a stereo extension. The AMR-WB+ codec utilizes both, ACELP coding and TCX models to encode the core mono signal in a frequency band of 0 Hz to 6400 Hz. For the TCX model, a coding frame length of 20 ms, 40 ms or 80 ms is utilized.

Since an ACELP model can degrade the audio quality and transform coding performs usually poorly for speech, especially when long coding frames are employed, the respective best coding model has to be selected depending on the properties of the signal which is to be coded. The selection of the coding model which is actually to be employed can be carried out in various ways.

In systems requiring low complexity techniques, like mobile multimedia services (MMS), usually music/speech classification algorithms are exploited for selecting the optimal coding model. These algorithms classify the entire source signal either as music or as speech based on an analysis of the energy and the frequency properties of the audio signal.

If an audio signal consists only of speech or only of music, it will be satisfactory to use the same coding model for the entire signal based on such a music/speech classification. In many other cases, however, the audio signal which is to be encoded is a mixed type of audio signal. For example, speech may be present at the same time as music and/or be temporally alternating with music in the audio signal.

In these cases, a classification of entire source signals into a music or a speech category is a too limited approach. The overall audio quality can then only be maximized by temporally switching between the coding models when coding the audio signal. That is, the ACELP model is partly used as well for coding a source signal classified as an audio signal other than speech, while the TCX model is partly used as well for a source signal classified as a speech signal. From the viewpoint of the coding model, one could refer to the signals as speech-like or music-like signals. Depending on the properties of the signal, either the ACELP coding model or the TCX model has better performance.

The extended AMR-WB (AMR-WB+) codec is designed as well for coding such mixed types of audio signals with mixed coding models on a frame-by-frame basis.

The selection of coding models in AMR-WB+can be carried out in several ways.

In the most complex approach, the signal is first encoded with all possible combinations of ACELP and TCX models. Next, the signal is synthesized again for each combination. The best excitation is then selected based on the quality of the synthesized speech signals. The quality of the synthesized speech resulting with a specific combination can be measured for example by determining its signal-to-noise ratio (SNR). This analysis-by-synthesis type of approach will provide good results. In some applications, however, it is not practicable, because of its very high complexity. Such applications include, for example, mobile applications. The complexity results largely from the ACELP coding, which is the most complex part of an encoder.

In systems like MMS, for example, the full closed-loop analysis-by-synthesis approach is far too complex to perform. In an MMS encoder, therefore, a low complex open-loop method is employed for determining whether an ACELP coding model or a TCX model is selected for encoding a particular frame.

AMR-WB+ offers two different low-complexity open-loop approaches for selecting the respective coding model for each frame. Both open-loop approaches evaluate source signal characteristics and encoding parameters for selecting a respective coding model.

In the first open-loop approach, an audio signal is first split up within each frame into several frequency bands, and the relation between the energy in the lower frequency bands and the energy in the higher frequency bands is analyzed, as well as the energy level variations in those bands. The audio content in each frame of the audio signal is then classified as a music-like content or a speech-like content based on both of the performed measurements or on different combinations of these measurements using different analysis windows and decision threshold values.

In the second open-loop approach, which is also referred to as model classification refinement, the coding model selection is based on an evaluation of the periodicity and the stationary properties of the audio content in a respective frame of the audio signal. Periodicity and stationary properties are evaluated more specifically by determining correlation, Long Term Prediction (LTP) parameters and spectral distance measurements.

Even though two different open loop approaches can be exploited for selecting the optimal coding model for each audio signal frame, still in some cases the optimal encoding model cannot be found with the existing code model selection algorithms. For example, the value of a signal characteristic evaluated for a certain frame may be neither clearly indicative of speech nor of music.

SUMMARY OF THE INVENTION

It is an object of the invention to improve the selection of a coding model which is to be employed for encoding a respective section of an audio signal.

A method of selecting a respective coding model for encoding consecutive sections of an audio signal is proposed, wherein at least one coding model optimized for a first type of audio content and at least one coding model optimized for a second type of audio content are available for selection. The method comprising selecting for each section of the audio signal a coding model based on at least one signal characteristic indicating the type of audio content in the respective section, if viable. The method further comprises selecting for each remaining section of the audio signal, for which a selection based on at least one signal characteristic is not viable, a coding model based on a statistical evaluation of the coding models which have been selected based on the at least one signal characteristic for neighboring sections of the respective remaining section.

It is to be understood that it is not required, even though possible, that the first selection step is carried out for all sections of the audio signal, before the second selection step is performed for the remaining sections of the audio signal.

Moreover, a module for encoding consecutive sections of an audio signal with a respective coding model is proposed. At least one coding model optimized for a first type of audio content and at least one coding model optimized for a second type of audio content are available in the encoder. The module comprises a first evaluation portion adapted to select for a respective section of the audio signal a coding model based on at least one signal characteristic indicating the type of audio content in this section, if viable. The module further comprises a second evaluation portion adapted to statistically evaluate the selection of coding models by the first evaluation portion for neighboring sections of each remaining section of an audio signal for which the first evaluation portion has not selected a coding model, and to select a coding model for each of the remaining sections based on the respective statistical evaluation. The module further comprises an encoding portion for encoding each section of the audio signal with the coding model selected for the respective section. The module can be for example an encoder or part of an encoder.

Moreover, an electronic device comprising an encoder with the features of the proposed module is proposed.

Moreover, an audio coding system comprising an encoder with the features of the proposed module and in addition a decoder for decoding consecutive encoded sections of an audio signal with a coding model employed for encoding the respective section is proposed.

Finally, a software program product is proposed, in which a software code for selecting a respective coding model for encoding consecutive sections of an audio signal is stored, is proposed. Again, at least one coding model optimized for a first type of audio content and at least one coding model optimized for a second type of audio content are available for selection. When running in a processing component of an encoder, the software code realizes the steps of the proposed method.

The invention proceeds from the consideration that the type of an audio content in a section of an audio signal will most probably be similar to the type of an audio content in neighboring sections of the audio signal. It is therefore proposed that in case the optimal coding model for a specific section cannot be selected unambiguously based on the evaluated signal characteristics, the coding models selected for neighboring sections of the specific section are evaluated statistically. It is to be noted that the statistical evaluation of these coding models may also be an indirect evaluation of the selected coding models, for example in form of a statistical evaluation of the type of content determined to be comprised by the neighboring sections. The statistical evaluation is then used for selecting the coding model which is most probably the best one for the specific section.

It is an advantage of the invention that it allows finding an optimal encoding model for most sections of an audio signal, even for most of those sections in which this is not possible with conventional open loop approaches for selecting the encoding model.

The different types of audio content may comprise in particular, though not exclusively, speech and other content than speech, for example music. Such other audio content than speech is frequently also referred to simply as audio. The selectable coding model optimized for speech is then advantageously an algebraic code-excited linear prediction coding model and the selectable coding model optimized for the other content is advantageously a transform coding model.

The sections of the audio signal which are taken into account for the statistical evaluation for a remaining section may comprise only sections preceding the remaining section, but equally sections preceding and following the remaining section. The latter approach further increases the probability of selecting the best coding model for a remaining section.

In one embodiment of the invention, the statistical evaluation comprises counting for each of the coding models the number of the neighboring sections for which the respective coding model has been selected. The number of selections of the different coding models can then be compared to each other.

In one embodiment of the invention, the statistical evaluation is a non-uniform statistical evaluation with respect to the coding models. For example, if the first type of audio content is speech and the second type of audio content is audio content other than speech, the number of sections with speech content are weighted higher than the number of sections with other audio content. This ensures for the entire audio signal a high quality of the encoded speech content.

In one embodiment of the invention, each of the sections of the audio signal to which a coding model is assigned corresponds to a frame.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not drawn to scale and that they are merely intended to conceptually illustrate the structures and procedures described herein.

DETAILED DESCRIPTION OF THE INVENTION

Figure 1:
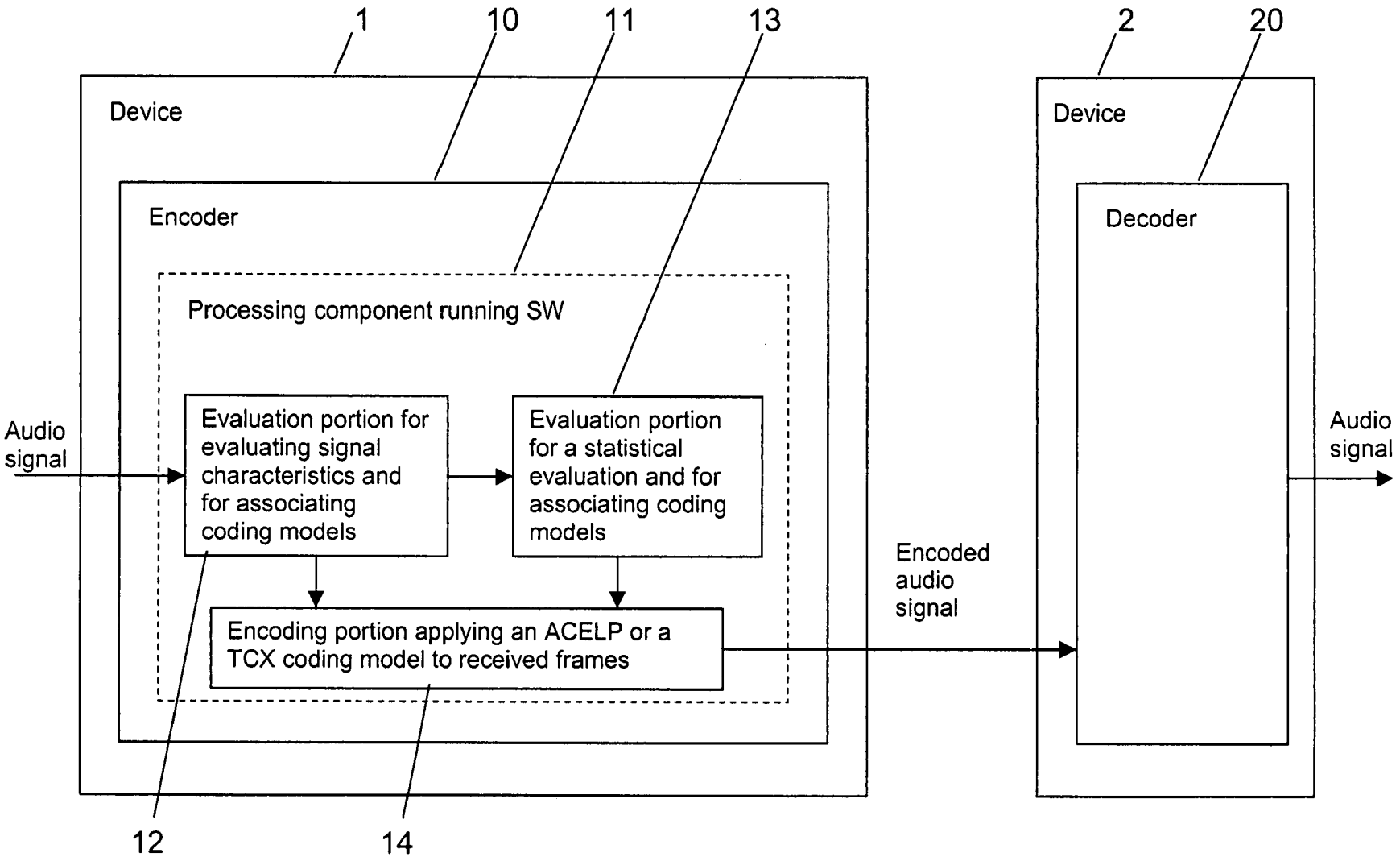
FIG. 1 is a schematic diagram of a system according to an embodiment of the invention.

FIG. 1 is a schematic diagram of an audio coding system according to an embodiment of the invention, which enables for any frame of an audio signal a selection of an optimal coding model.

The system comprises a first device 1 including an AMR-WB+ encoder 10 and a second device 2 including an AMR-WB+ decoder 20. The first device 1 can be for instance an MMS server, while the second device 2 can be for instance a mobile phone or another mobile device.

The encoder 10 of the first device 1 comprises a first evaluation portion 12 for evaluating the characteristics of incoming audio signals, a second evaluation portion 13 for statistical evaluations and an encoding portion 14. The first evaluation portion 12 is linked on the one hand to the encoding portion 14 and on the other hand to the second evaluation portion 13. The second evaluation portion 13 is equally linked to the encoding portion 14. The encoding portion 14 is preferably able to apply an ACELP coding model or a TCX model to received audio frames.

The first evaluation portion 12, the second evaluation portion 13 and the encoding portion 14 can be realized in particular by a software SW run in a processing component 11 of the encoder 10, which is indicated by dashed lines.

Figure 2:
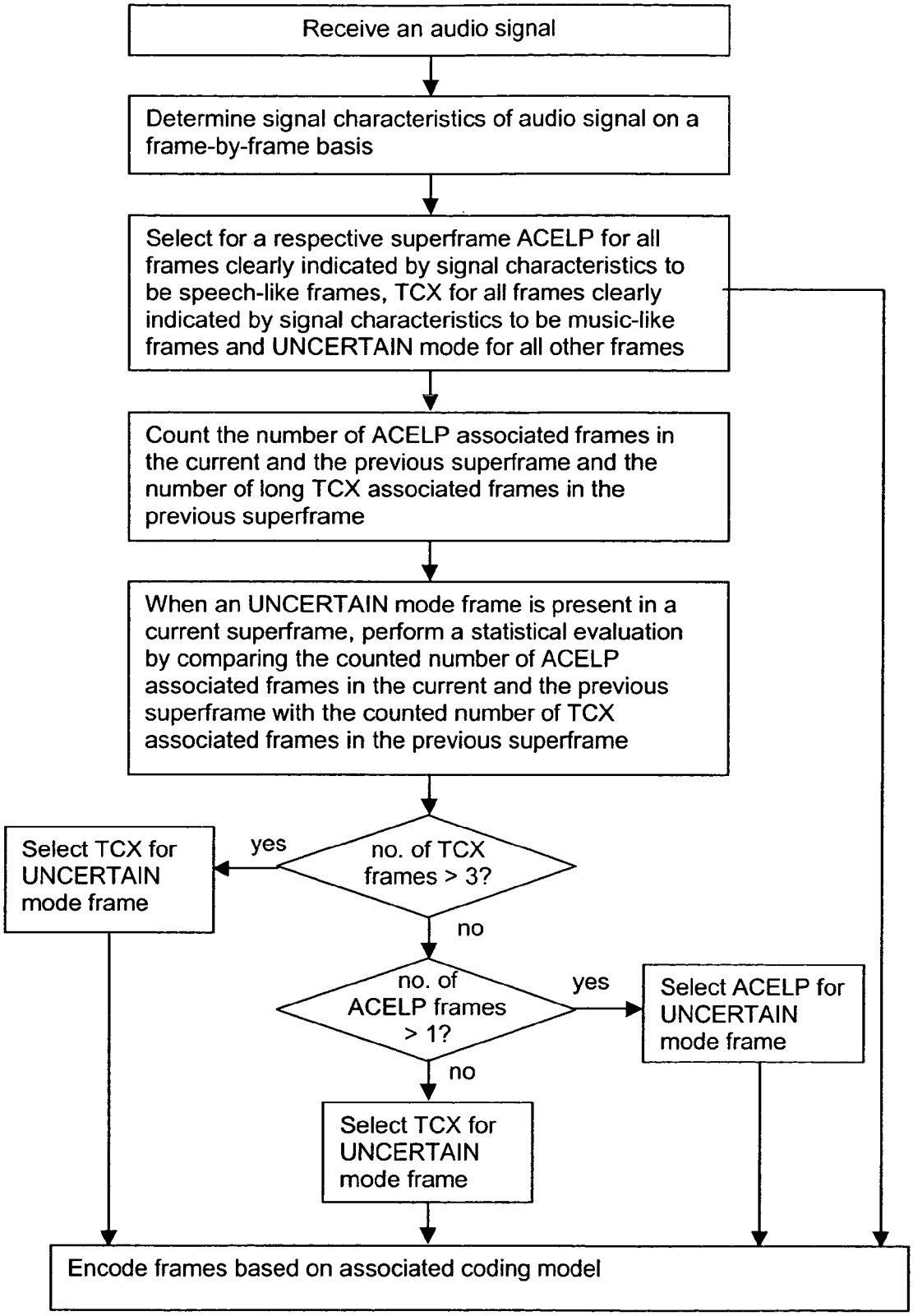
FIG. 2 is a flow chart illustrating the operation in the system of FIG. 1.

The operation of the encoder 10 will now be described in more detail with reference to the flow chart of FIG. 2.

The encoder 10 receives an audio signal which has been provided to the first device 1.

A linear prediction (LP) filter (not shown) calculates linear prediction coefficients (LPC) in each audio signal frame to model the spectral envelope. The LPC excitation output by the filter for each frame is to be encoded by the encoding portion 14 either based on an ACELP coding model or a TCX model.

For the coding structure in AMR-WB+, the audio signal is grouped in superframes of 80 ms, each comprising four frames of 20 ms. The encoding process for encoding a superframe of 4*20 ms for transmission is only started when the coding mode selection has been completed for all audio signal frames in the superframe.

For selecting the respective coding model for the audio signal frames, the first evaluation portion 12 determines signal characteristics of the received audio signal on a frame-by-frame basis for example with one of the open-loop approaches mentioned above. Thus, for example the energy level relation between lower and higher frequency bands and the energy level variations in lower and higher frequency bands can be determined for each frame with different analysis windows as signal characteristics. Alternatively or in addition, parameters which define the periodicity and stationary properties of the audio signal, like correlation values, LTP parameters and/or spectral distance measurements, can be determined for each frame as signal characteristics. It is to be understood that instead of the above mentioned classification approaches, the first evaluation portion 12 could equally use any other classification approach which is suited to classify the content of audio signal frames as music- or speech-like content.

The first evaluation portion 12 then tries to classify the content of each frame of the audio signal as music-like content or as speech-like content based on threshold values for the determined signal characteristics or combinations thereof.

Most of the audio signal frames can be determined this way to contain clearly speech-like content or music-like content.

For all frames for which the type of the audio content can be identified unambiguously, an appropriate coding model is selected. More specifically, for example, the ACELP coding model is selected for all speech frames and the TCX model is selected for all audio frames.

As already mentioned, the coding models could also be selected in some other way, for example in an closed-loop approach or by a pre-selection of selectable coding models by means of an open-loop approach followed by a closed-loop approach for the remaining coding model options.

Information on the selected coding models is provided by the first evaluation portion 12 to the encoding portion 14.

In some cases, however, the signal characteristics are not suited to clearly identify the type of content. In these cases, an UNCERTAIN mode is associated to the frame.

Information on the selected coding models for all frames are provided by the first evaluation portion 12 to the second evaluation portion 13. The second evaluation portion 13 now selects a specific coding model as well for the UNCERTAIN mode frames based on a statistical evaluation of the coding models associated to the respective neighboring frames, if a voice activity indicator VADflag is set for the respective UNCERTAIN mode frame. When the voice activity indicator VADflag is not set, the flag thereby indicating a silent period, the selected mode is TCX by default and none of the mode selection algorithms has to be performed.

For the statistical evaluation, a current superframe, to which an UNCERTAIN mode frame belongs, and a previous superframe preceding this current superframe are considered. The second evaluation portion 13 counts by means of counters the number of frames in the current superframe and in the previous superframe for which the ACELP coding model has been selected by the first evaluation portion 12. Moreover, the second evaluation portion 13 counts the number of frames in the previous superframe for which a TCX model with a coding frame length of 40 ms or 80 ms has been selected by the first evaluation portion 12, for which moreover the voice activity indicator is set, and for which in addition the total energy exceeds a predetermined threshold value. The total energy can be calculated by dividing the audio signal into different frequency bands, by determining the signal level separately for all frequency bands, and by summing the resulting levels. The predetermined threshold value for the total energy in a frame may be set for instance to 60.

The counting of frames to which an ACELP coding model has been assigned is thus not limited to frames preceding an UNCERTAIN mode frame. Unless the UNCERTAIN mode frame is the last frame in the current superframe, also the selected encoding models of upcoming frames are take into account.

Figure 3:
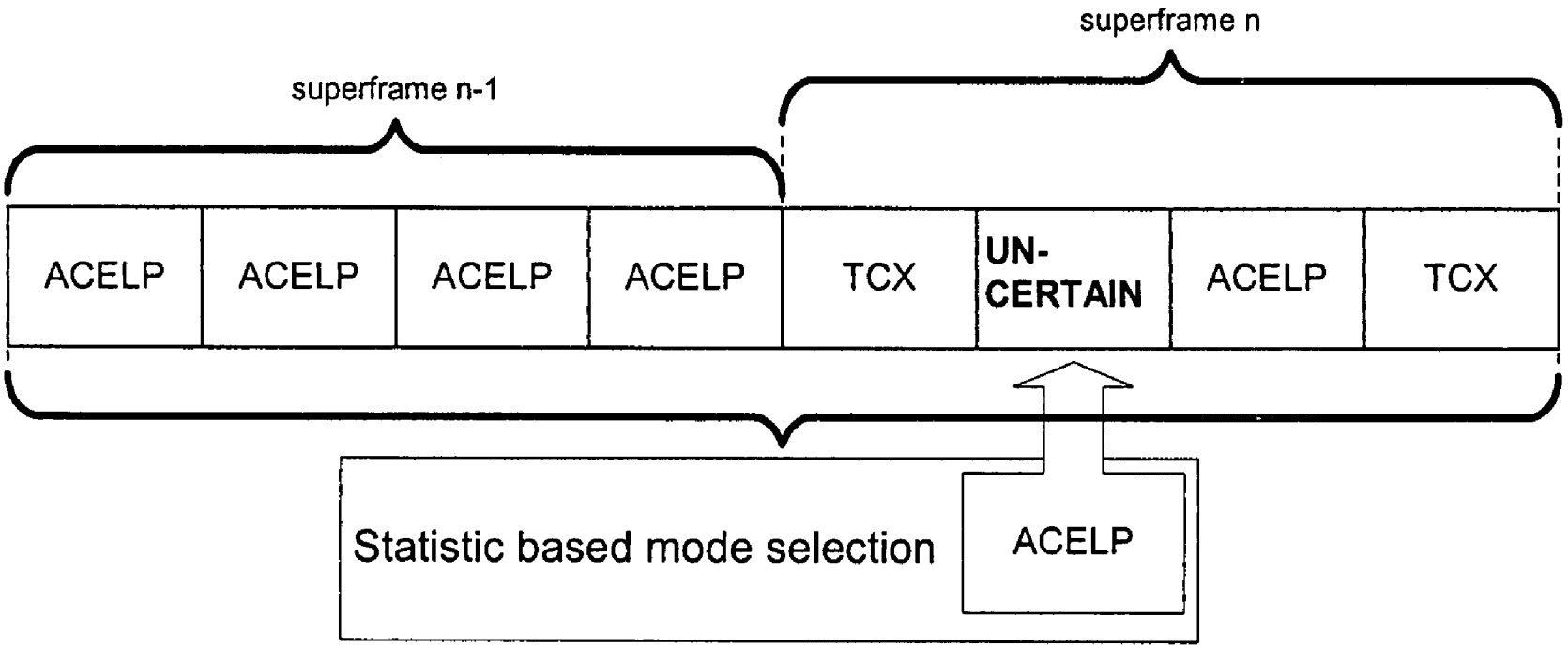
FIG. 3 is a frame diagram illustrating the operation in the system of FIG. 1.

This is illustrated in FIG. 3, which presents by way of an example the distribution of coding modes indicated by the first evaluation portion 12 to the second evaluation portion 13 for enabling the second evaluation portion 13 to select a coding model for a specific UNCERTAIN mode frame.

FIG. 3 is a schematic diagram of a current superframe n and a preceding superframe n−1. Each of the superframes has a length of 80 ms and comprises four audio signal frames having a length of 20 ms. In the depicted example, the previous superframe n−1 comprises four frames to which an ACELP coding model has been assigned by the first evaluation portion 12. The current superframe n comprises a first frame, to which a TCX model has been assigned, a second frame to which an UNDEFINED mode has been assigned, a third frame to which an ACELP coding model has been assigned and a fourth frame to which again a TCX model has been assigned.

As mentioned above, the assignment of coding models has to be completed for the entire current superframe n, before the current superframe n can be encoded. Therefore, the assignment of the ACELP coding model and the TCX model to the third frame and the fourth frame, respectively, can be considered in the statistical evaluation which is carried out for selecting a coding model for the second frame of the current superframe.

The counting of frames can be summarized for instance by the following pseudo-code:

```
if ((prevMode(i) == TCX80 or prevMode(i) == TCX40) and
vadFlag_old(i) == 1 and TotE_i > 60)
    TCXCount = TCXCount + 1
if (prevMode(i) == ACELP_MODE)
    ACELPCount = ACELPCount + 1
if (j ! = i)
    if (Mode(i) == ACELP_MODE)
        ACELPCount = ACELPCount + 1
```

In this pseudo-code, i indicates the number of a frame in a respective superframe, and has the values 1, 2, 3, 4, while j indicates the number of the current frame in the current superframe. prevMode (i) is the mode of the ith frame of 20 ms in the previous superframe and Mode(i) is the mode of the ith frame of 20 ms in the current superframe. TCX80 represents a selected TCX model using a coding frame of 80 ms and TCX40 represents a selected TCX model using a coding frame of 40 ms. $vadFlag_{old}(i)$ represents the voice activity indicator VAD for the ith frame in the previous superframe. $TotE_i$ is the total energy in the ith frame. The counter value TCXCount represents the number of selected long TCX frames in the previous superframe, and the counter value ACELPCount represents the number of ACELP frames in the previous and the current superframe.

The statistical evaluation is performed as follows:

If the counted number of long TCX mode frames, with a coding frame length of 40 ms or 80 ms, in the previous superframe is larger than 3, a TCX model is equally selected for the UNCERTAIN mode frame.

Otherwise, if the counted number of ACELP mode frames in the current and the previous superframe is larger than 1, an ACELP model is selected for the UNCERTAIN mode frame.

In all other cases, a TCX model is selected for the UNCERTAIN mode frame.

It becomes apparent that with this approach, the ACELP model is favored compared to the TCX model.

The selection of the coding model for the jth frame Mode(j) can be summarized for instance by the following pseudo-code:

```
if (TCXCount > 3)
    Mode(j) = TCX_MODE;
else if (ACELPCOunt > 1)
    Mode(j) = ACELP_MODE
else
    Mode(j) = TCX_MODE
```

In the example of FIG. 3, an ACELP coding model is selected for the UNCERTAIN mode frame in the current superframe n.

It is to be noted that another and more complicated statistical evaluation could be used as well for determining the coding model for UNCERTAIN frames. Further, it is also possible to exploit more than two superframes for collecting the statistical information on neighboring frames, which is used for determining the coding model for UNCERTAIN frames. In AMR-WB+, however, advantageously a relatively simple statistically based algorithm is employed in order to achieve a low complexity solution. A fast adaptation for audio signals with speech between music content and speech over music content can also be achieved when exploiting only the respective current and previous superframe in the statistically based mode selection.

The second evaluation portion 13 now provides information on the coding model selected for a respective UNCERTAIN mode frame to the encoding portion 14.

The encoding portion 14 encodes all frames of a respective superframe with the respectively selected coding model, indicated either by the first evaluation portion 12 or the second evaluation portion 13. The TCX is based by way of example on a fast Fourier transform (FFT), which is applied to the LPC excitation output of the LP filter for a respective frame. The ACELP coding uses by way of example an LTP and fixed codebook parameters for the LPC excitation output by the LP filter for a respective frame.

The encoding portion 14 then provides the encoded frames for transmission to the second device 2. In the second device 2, the decoder 20 decodes all received frames with the ACELP coding model or with the TCX model, respectively. The decoded frames are provided for example for presentation to a user of the second device 2.

While there have been shown and described and pointed out fundamental novel features of the invention as applied to a preferred embodiment thereof, it will be understood that various omissions and substitutions and changes in the form and details of the devices and methods described may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A method of selecting a respective coding model for encoding consecutive sections of an audio signal said method comprising:

selecting for each section of said audio signal a coding model based on at least one signal characteristic indicating the type of audio content in the respective section, if said at least one signal characteristic unambiguously indicates a particular type of audio content, wherein at least one coding model optimized for a first type of audio content and at least one coding model optimized for a second type of audio content are available for selection, and wherein said first type of audio content is speech and wherein said second type of audio content is audio content other than speech; and selecting for each remaining section of said audio signal, for which said at least one signal characteristic does not unambiguously indicate a particular type of audio content, either said coding model optimized for said first type of audio content or said coding model optimized for said second type of audio content based on a statistical evaluation of the coding models which have been selected based on said at least one signal characteristic for neighboring sections of the respective remaining section, wherein said statistical evaluation comprises counting for each of said coding models the number of said neighboring sections for which the respective coding model has been selected, and wherein the number of neighboring sections for which said coding model optimized for said first type of audio content has been selected is weighted higher in said statistical evaluation than the number of sections for which said coding model optimized for said second type of audio content has been selected.

2. The method according to claim 1, wherein said coding models comprise an algebraic code-excited linear prediction coding model and a transform coding model.

3. The method according to claim 1, wherein said statistical evaluation takes account of coding models selected for sections preceding a respective remaining section and, if available, of coding models selected for sections following said remaining section.

4. The method according to claim 1, wherein said statistical evaluation is a non-uniform statistical evaluation with respect to said coding models.

5. The method according to claim 1, wherein each of said sections of said audio signal corresponds to a frame.

6. A method of selecting a respective coding model for encoding consecutive frames of an audio signal, said method comprising:

selecting for each frame of said audio signal, for which signal characteristics indicate that a content of said frame is speech, an algebraic code-excited linear prediction coding model;

selecting for each frame of said audio signal, for which said signal characteristics indicate that a content of said frame is audio content other than speech, a transform coding model; and selecting for each remaining frame of said audio signal, for which said signal characteristics do not unambiguously indicate that a content of said frame is speech or unambiguously indicate that a content of said frame is audio content other than speech, either said algebraic code-excited linear prediction coding model or said transform coding model based on a statistical evaluation of the coding models which have been selected based on said signal characteristics for neighboring frames of a respective remaining frame, wherein said statistical evaluation comprises counting for each of said coding models the number of said neighboring sections for which the respective coding model has been selected, and wherein the number of neighboring sections for which said algebraic code-excited linear prediction coding model has been selected is weighted higher in said statistical evaluation than the number of sections for which said transform coding model has been selected.

7. An apparatus for encoding consecutive sections of an audio signal with a respective coding model, said apparatus comprising a processing component and a software program product in which a software code is stored, said processing component configured to execute the software code, and the software code comprising:

a first evaluation portion configured to cause the apparatus to select for a respective section of said audio signal a coding model based on at least one signal characteristic indicating the type of audio content in said section, if said at least one signal characteristic unambiguously indicates a particular type of audio content, wherein at least one coding model optimized for a first type of audio content and at least one coding model optimized for a second type of audio content are available, wherein said first type of audio content is speech and wherein said second type of audio content is audio content other than speech;

a second evaluation portion configured to cause the apparatus to statistically evaluate the selection of coding models by said first evaluation portion for neighboring sections of each remaining section of an audio signal for which said first evaluation portion has not selected a coding model, configured to cause the apparatus for said statistical evaluation to count for each of said coding models the number of said neighboring sections for which the respective coding model has been selected by said first evaluation portion, configured to cause the apparatus to weight the number of neighboring sections, for which said coding model optimized for said first type of audio content has been selected by said first evaluation portion, higher in said statistical evaluation than the number of sections, for which said coding model optimized for said second type of audio content has been selected by said first evaluation portion, and configured to select either said coding model optimized for said first type of audio content or said coding model optimized for said second type of audio content for each of said remaining sections based on the respective statistical evaluation; and an encoding portion configured to cause the apparatus to encode each section of said audio signal with the coding model selected for the respective section.

8. The apparatus according to claim 7, wherein said coding models comprise an algebraic code-excited linear prediction coding model and a transform coding model.

9. The apparatus according to claim 7, wherein said second evaluation portion is configured to cause the apparatus to take account in said statistical evaluation of coding models selected by said first evaluation portion for sections preceding a respective remaining section and, if available, of coding models selected by said first evaluation portion for sections following said remaining section.

10. The apparatus according to claim 7, wherein said second evaluation portion is configured to cause the apparatus to perform a non-uniform statistical evaluation with respect to said coding models.

11. The apparatus according to claim 7, wherein each of said sections of said audio signal corresponds to a frame.

12. The apparatus according to claim 7, wherein said apparatus is an encoder.

13. An electronic device comprising an encoder for encoding consecutive sections of an audio signal with a respective coding model, said encoder including a processing component and a software program product in which a software code is stored, said processing component configured to execute the software code, and the software code comprising:

a first evaluation portion configured to cause the encoder to select for a respective section of said audio signal a coding model based on at least one signal characteristic indicating the type of audio content in said section, if said at least one signal characteristic unambiguously indicates a particular type of audio content, wherein at least one coding model optimized for a first type of audio content and at least one coding model optimized for a second type of audio content are available, wherein said first type of audio content is speech and wherein said second type of audio content is audio content other than speech;

a second evaluation portion configured to cause the encoder to statistically evaluate the selection of coding models by said first evaluation portion for neighboring sections of each remaining section of an audio signal for which said first evaluation portion has not selected a coding model, configured to cause the encoder for said statistical evaluation to count for each of said coding models the number of said neighboring sections for which the respective coding model has been selected by said first evaluation portion, configured to cause the encoder to weight the number of neighboring sections, for which said coding model optimized for said first type of audio content has been selected by said first evaluation portion, higher in said statistical evaluation than the number of sections, for which said coding model optimized for said second type of audio content has been selected by said first evaluation portion, and configured to select either said coding model optimized for said first type of audio content or said coding model optimized for said second type of audio content for each of said remaining sections based on the respective statistical evaluation; and an encoding portion configured to cause the encoder to encode each section of said audio signal with the coding model selected for the respective section.

14. An audio coding system comprising an encoder for encoding consecutive sections of an audio signal with a respective coding model and a decoder for decoding consecutive encoded sections of an audio signal with a coding model employed for encoding the respective section, said encoder including a processing component and a software program product in which a software code is stored, said processing component configured to execute the software code, and the software code comprising:

a first evaluation portion configured to cause the encoder to select for a respective section of said audio signal a coding model based on at least one signal characteristic indicating the type of audio content in said section, if said at least one signal characteristic unambiguously indicates a particular type of audio content, wherein at least one coding model optimized for a first type of audio content and at least one coding model optimized for a second type of audio content are available at said encoder and at said decoder, wherein said first type of audio content is speech and wherein said second type of audio content is audio content other than speech;

a second evaluation portion configured to cause the encoder to statistically evaluate the selection of coding models by said first evaluation portion for neighboring sections of each remaining section of an audio signal for which said first evaluation portion has not selected a coding model, configured to cause the encoder for said statistical evaluation to count for each of said coding models the number of said neighboring sections for which the respective coding model has been selected by said first evaluation portion, configured to cause the encoder to weight the number of neighboring sections, for which said coding model optimized for said first type of audio content has been selected by said first evaluation portion, higher in said statistical evaluation than the number of sections, for which said coding model optimized for said second type of audio content has been selected by said first evaluation portion, and configured to select either said coding model optimized for said first type of audio content or said coding model optimized for said second type of audio content for each of said remaining sections based on the respective statistical evaluation; and an encoding portion configured to cause the encoder to encode each section of said audio signal with the coding model selected for the respective section.

15. A software program product in which a software code for selecting a respective coding model for encoding consecutive sections of an audio signal is stored, said software code realizing the following steps when running in a processing component of an encoder:

selecting for each section of said audio signal a coding model based on at least one signal characteristic indicating the type of audio content in the respective section, if said at least one signal characteristic unambiguously indicates a particular type of audio content, wherein at least one coding model optimized for a first type of audio content and at least one coding model optimized for a second type of audio content are available for selection, wherein said first type of audio content is speech and wherein said second type of audio content is audio content other than speech; and selecting for each remaining section of said audio signal, for which said at least one signal characteristic does not unambiguously indicate a particular type of audio content, either said coding model optimized for said first type of audio content or said coding model optimized for said second type of audio content based on a statistical evaluation of the coding models which have been selected based on said at least one signal characteristic for neighboring sections of the respective remaining section, wherein said statistical evaluation comprises counting for each of said coding models the number of said neighboring sections for which the respective coding model has been selected, and wherein the number of neighboring sections for which said coding model optimized for said first type of audio content has been selected is weighted higher in said statistical evaluation than the number of sections for which said coding model optimized for said second type of audio content has been selected.

16. The electronic device according to claim 13, wherein said coding models comprise an algebraic code-excited linear prediction coding model and a transform coding model.

17. The audio coding system according to claim 14, wherein said coding models comprise an algebraic code-excited linear prediction coding model and a transform coding model.

18. The software program product according to claim 15, wherein said coding models comprise an algebraic code-excited linear prediction coding model and a transform coding model.

19. An apparatus comprising the following means, which are implemented at least partly in hardware:

means for selecting for each section of an audio signal a coding model based on at least one signal characteristic indicating the type of audio content in the respective section, if said at least one signal characteristic unambiguously indicates a particular type of audio content, wherein a coding model optimized for a first type of audio content and a coding model optimized for a second type of audio content are available for selection, wherein said first type of audio content is speech and wherein said second type of audio content is audio content other than speech; and means for selecting for each remaining section of said audio signal, for which said at least one signal characteristic does not unambiguously indicate a particular type of audio content, either said coding model optimized for said first type of audio content or said coding model optimized for said second type of audio content based on a statistical evaluation of the coding models which have been selected based on said at least one signal characteristic for neighboring sections of the respective remaining section, wherein said statistical evaluation comprises counting for each of said coding models the number of said neighboring sections for which the respective coding model has been selected, and wherein the number of neighboring sections for which said coding model optimized for said first type of audio content has been selected is weighted higher in said statistical evaluation than the number of sections for which said coding model optimized for said second type of audio content has been selected.

* * * * *